United States Patent [19]

Szajna

[11] Patent Number: 4,566,509

[45] Date of Patent: Jan. 28, 1986

[54] CLOSURE UNIT INCLUDING MEASURING CUP

[75] Inventor: John L. Szajna, Norridge, Ill.

[73] Assignee: Continental Plastic Containers, Inc., Stamford, Conn.

[21] Appl. No.: 628,940

[22] Filed: Jul. 9, 1984

[51] Int. Cl.[4] ..... B65D 45/30

[52] U.S. Cl. ..... 141/381; 215/228; 215/276; 215/DIG. 7

[58] Field of Search ..... 141/381; 215/DIG. 7, 215/228, 276

[56] References Cited

U.S. PATENT DOCUMENTS

| | | | |
|---|---|---|---|
| 653,262 | 7/1900 | Rodiger | 141/381 |
| 1,337,034 | 4/1920 | Bauermeister | 215/276 X |
| 1,760,841 | 5/1930 | Garhart | 215/276 X |
| 1,780,875 | 11/1930 | Gordon | 141/381 |
| 2,061,685 | 11/1936 | Wheaton | 141/381 |
| 2,108,692 | 2/1938 | Pleck | 215/276 X |
| 4,176,755 | 12/1979 | Winchell | 215/276 X |
| 4,349,056 | 9/1982 | Heino | 141/381 |

FOREIGN PATENT DOCUMENTS

| | | | |
|---|---|---|---|
| 83506 | 7/1983 | European Pat. Off. | 215/228 |

*Primary Examiner*—Donald F. Norton

*Attorney, Agent, or Firm*—Charles E. Brown

[57] ABSTRACT

This relates to a closure unit which is of a two-piece construction including a measuring cup and a ring member. The ring member includes an annular flange and a skirt having formed thereon locking elements such as threads for engaging the neck finish of a container. The measuring cup is provided mid-height with a flange which is clamped against an end sealing surface of a container by the annular flange of the ring member. The measuring cup is formed of a resilient plastic material so that the flange of the measuring cup has a gasket-like characteristic and can form a seal with the end sealing surface of an associated container. The measuring cup may be fixed relative to the ring member or may be axially movable relative thereto so that in condition of use an open end of the measuring cup will project beyond the skirt of the ring member to permit pouring from the measuring cup. Because the open end of the measuring cup is positioned within the container after use, any residue on the measuring cup drains back into the container.

7 Claims, 11 Drawing Figures

FIG.1
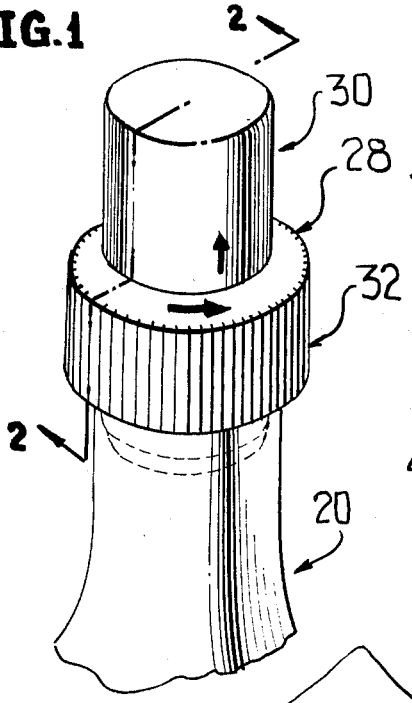
FIG.2
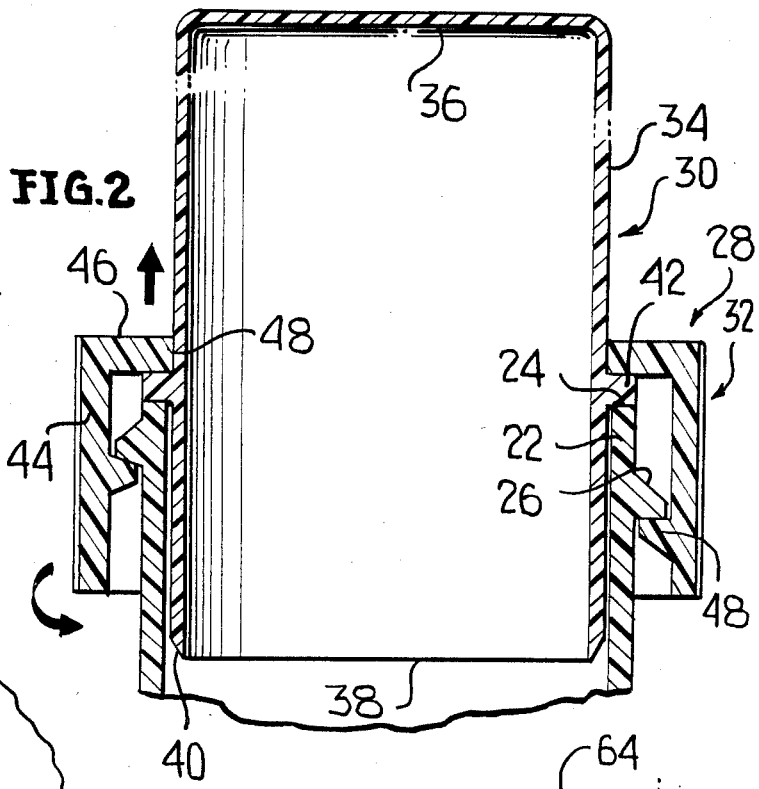
FIG.3
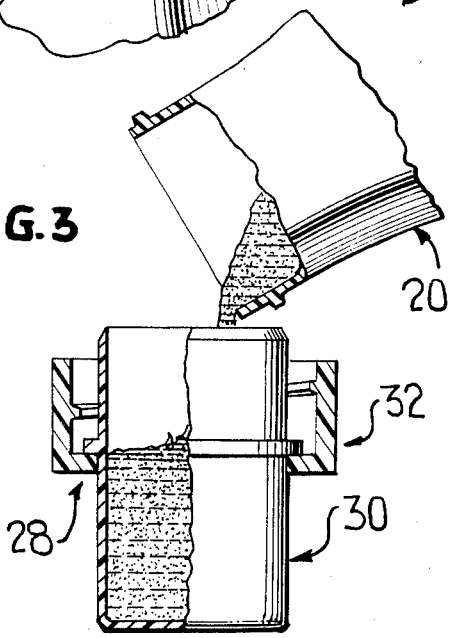
FIG.5
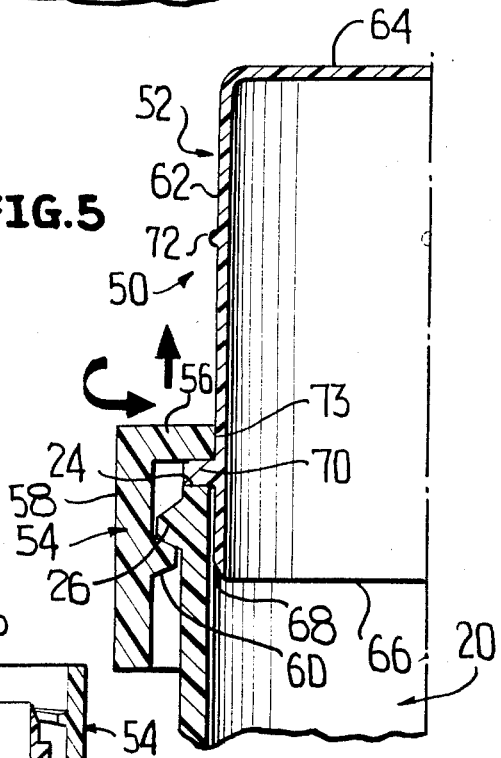
FIG.4
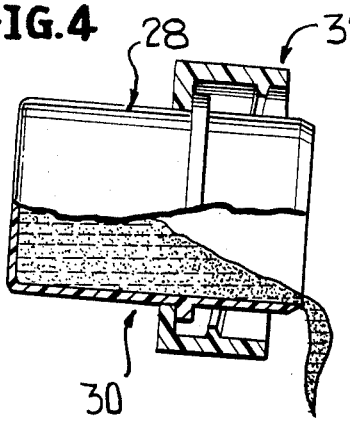
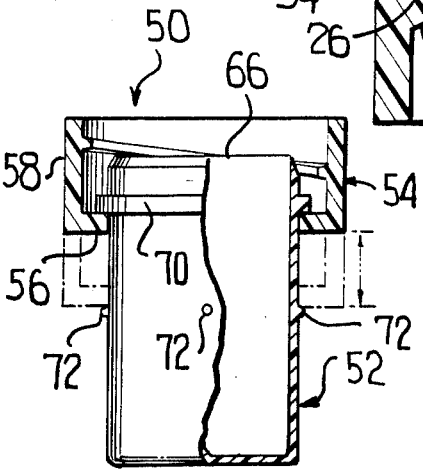
FIG.6

FIG.7
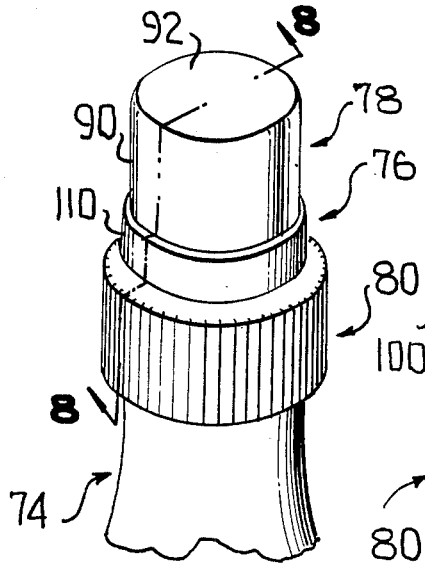
FIG.10
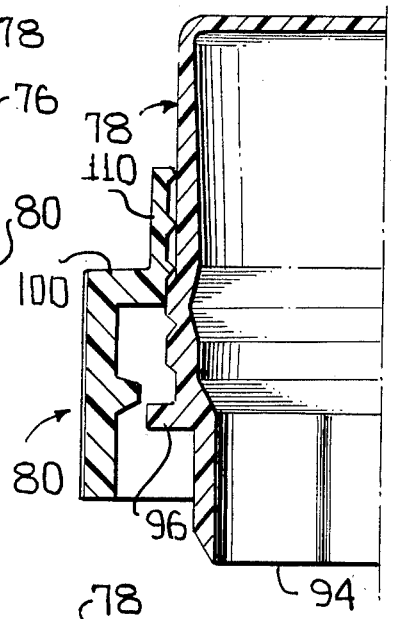
FIG.8
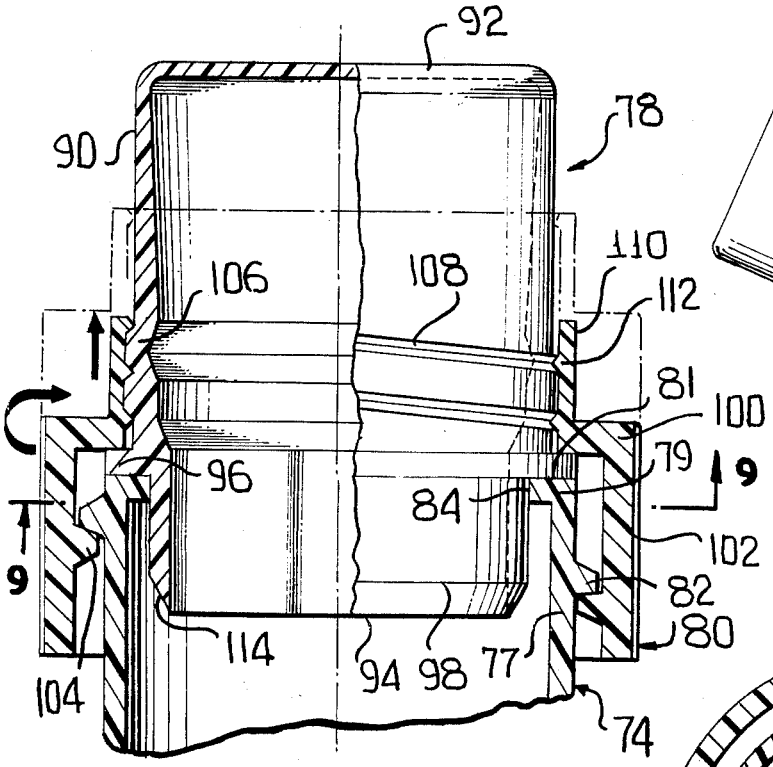
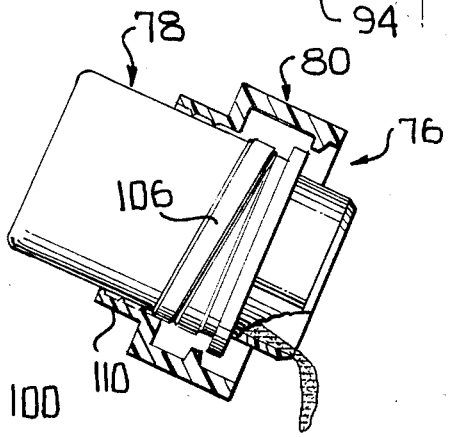
FIG.11
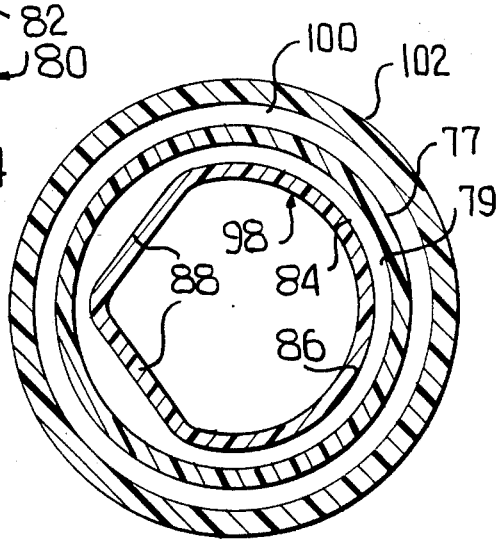
FIG.9

CLOSURE UNIT INCLUDING MEASURING CUP

This invention relates in general to new and useful improvements in closures for containers, and more particularly to a closure unit which incorporates a measuring cup.

Many container systems utilize the basic closure as a means of measuring the dosage of the product to be dispensed. When the closure is replaced onto the container, residue in the closure flows onto the neck finish and down the exterior of the container. The net result is an undesirable mess.

In another system (a one-piece system) the bottom edge of the measuring cup is allowed to "soak" in the product, causing a dripping from the measuring cup onto the exterior of the measuring cup.

In yet another system which is similar to an oil spout for motor oil, the spout offers only a small hole for filling and a small opening for drip return. This system requires double gaskets and is unduly expensive.

In accordance with this invention there is provided a closure unit which includes a measuring cup wherein the body of the measuring cup is provided with a flange which seats on and seals with the neck finish of a container. The closure unit also includes a ring member which engages the flange and clamps the flange against the container neck finish when a skirt of the ring member is interlocked with the neck finish. In this arrangement the measuring cup telescopes within the container and any residue within the measuring cup after usage runs only into the interior of the container.

The measuring cup is formed of a resilient plastic material so that the retaining flange thereof functions as a self-gasket.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a top perspective view of a bottle which is closed by one form of closure unit in accordance with this invention.

FIG. 2 is an enlarged fragmentary sectional view taken generally along the line 2—2 of FIG. 1, and shows the specific details of the closure unit.

FIG. 3 is a schematic elevational view with parts shown in section illustrating the manner in which the measuring cup of the closure unit is filled to a desired level with a pourable product from the bottle.

FIG. 4 is another schematic elevational view with parts in section showing the manner in which the measured quantity of the product is poured from the measuring cup.

FIG. 5 is a half sectional view similar to FIG. 2, and shows a modified form of closure unit wherein the ring member is slid axially relative to the measuring cup to an out-of-the-way position.

FIG. 6 is an elevational view with parts in section showing the manner in which the ring member is moved relative to the measuring cup so as to clear the open end of the measuring cup to facilitate pouring of a product therefrom.

FIG. 7 is a top perspective view of still another form of closure unit.

FIG. 8 is an enlarged fragmentary vertical sectional view taken generally along the line 8—8 of FIG. 7, and shows the specifics of the closure unit.

FIG. 9 is a transverse horizontal sectional view taken generally along the line 9—9 of FIG. 8, and shows the specific closure section of the open end portion of the measuring cup.

FIG. 10 is a half vertical sectional view taken through the closure unit with the ring member in its axially shifted position relative to the measuring cup.

FIG. 11 is an elevational view with parts broken away and shown in section of the closure unit with the ring member shifted axially relative to the measuring cup and a product being poured from the measuring cup.

Referring now to the drawings in detail, it will be seen that there is illustrated in FIG. 1 a conventional container such as a bottle which is generally identified by the numeral 20. The bottle may be of any construction, glass or plastic, and is provided with a neck finish 22 which includes a sealing surface 24 at the end thereof and radially outwardly directed retaining means 26 which are preferably in the form of threads.

The container or bottle 20 is closed by a closure unit formed in accordance with this invention and generally identified by the numeral 28. The closure 28 is of a two-piece construction and includes a measuring cup generally identified by the numeral 30 and a ring member generally identified by the numeral 32.

As is best shown in FIG. 2, the measuring cup 30 is formed with a cylindrical body 34 and an integral bottom 36. The opposite end or mouth of the measuring cup 30 is open as at 38. In addition, the open end portion of the body 34 is radially inwardly tapered as at 40 to facilitate the entry of the open end of the measuring cup 30 into the neck finish 22 of the bottle 20.

The measuring cup 30 which is formed of a resilient plastic material is provided integral with the body 34 thereof intermediate the ends of the body with a radially inwardly directed flange 42. The flange 42, being formed of a resilient plastic material, when it seats on the sealing surface 24 functions as a self-gasket and forms a seal therewith.

The ring member 32 includes an annular flange 46 defining an opening 48 of a diameter snugly to receive the body 34. At this time it is pointed out that the diameter of the body 34 between the flange 42 and the open end 38 is of a diameter loosely to fit within the container neck finish.

The ring member 32 also includes a skirt 44 which depends from the annular flange 46 and is formed integrally therewith. The interior surface of the skirt 44 is provided with integral threads 48 which are engageable with the threads 26 to form a releasable interlock between the ring member 32 and the neck finish 22.

The ring member 32 is also preferably formed of a plastic material, and the exterior surface of the skirt 44 may be roughened or knurled as shown in FIG. 1 to facilitate the gripping thereof to effect rotation relative to the bottle 20.

It is to be noted that the relationship of the measuring cup 30 to the ring member 32 is one wherein the open end 38 of the measuring cup body projects axially beyond the lower end of the skirt 44. Thus, the ring member 32 in no way interferes with the pouring of a product from the measuring cup 30.

Referring now to FIG. 3, it will be seen that after the closure unit 28 has been removed from the bottle 20 and is inverted, it is immediately available for the dispensing of a prescribed dosage of the product which is within the bottle 20. The product is merely poured from the bottle 20 into the measuring cup 30.

As has been generally referred to above and is best shown in FIG. 4, after the required dosage has been placed in the measuring cup 30, the dosage may be readily dispensed from the measuring cup 30 by pouring as shown in FIG. 4 without interference from the ring member 32.

As will be readily apparent, once the product has been poured from the measuring cup 30, the closure unit 28 is ready to be used in the resealing of the bottle 20. The resealing is initiated by inverting the closure unit 28 and immediately telescoping the open end of the measuring cup 30 into the bottle. After the open end 38 is received partially within the bottle, the ring member 32 is utilized to advance the measuring cup 30 further into the bottle and finally to clamp the flange 42 into sealing engagement with the sealing surface 24 of the bottle. Any residue within the measuring cup 30 will ultimately flow into the bottle.

Referring now to FIG. 5, it will be seen that there is illustrated another form of closure unit which is generally identified by the numeral 50. The closure unit 50 includes a measuring cup generally identified by the numeral 52 and a ring member generally identified by the numeral 54. For descriptive purposes, the ring member 54 is identical to the ring member 32 and includes an annular flange 56 and an integral depending skirt 58 having formed on the inner surface thereof threads 60 for interlocking engagement with the threads 26 on the bottle 20.

The measuring cup 52 is similar to but differs from the measuring cup 30. The measuring cup 52 includes a generally cylindrical body 62 which is closed at one end by an integral bottom 64 and is provided at the other end with an open end 66. The body 62 at the open end 66 is radially inwardly tapered as at 68 to facilitate entry into the neck of the bottle 20.

Like the measuring cup 30, the measuring cup 52 is provided with a flange 70 which is intended to be clamped against the sealing surface 24 of the bottle 20 by the flange 56. However, the flange 70 is spaced closer to the open end 66 than the flange 42 to the open end 38 of the measuring cup 30. As a result, the upper end 66 is in the condition of closure telescoped within the ring member 54.

It is to be noted that the body 62 is provided with a plurality of buttons 72 adjacent to but spaced from the bottom wall 64. The buttons 72 function as a stop member.

The annular flange 56 defines an opening 74 through which the body 62 passes. While the body 62 closely fits within the opening 73, the body is axially movable through the opening relative to the ring member 54.

Referring now to FIG. 6, it will be seen that when the measuring cup 52 is to be utilized the closure unit 50 is removed from the bottle 20 and thereafter the ring member 54 is shifted axially relative to the measuring cup 52 so that the annular flange 56 moves away from the flange 70 and engages the stop 72. The open end 66 now projects beyond the skirt 58 and the measuring cup 52 is available for dispensing a preselected quantity of the product packaged within the bottle 20.

It is to be understood that the measuring cup 52 and the ring member 54 will be formed of the same materials described with respect to the closure unit 28. Thus, the flange 70 may function additionally as a gasket to form a seal with the sealing surface 24 of the bottle.

Reference is now made to FIGS. 7–11 wherein there is illustrated in association with a bottle 74 yet another form of closure unit generally identified by the numeral 76. The closure unit 76 also is of a two-piece construction and includes a measuring cup 78 and a ring member 80. There are, however, numerous differences between the closure unit 76 and the closure units 28 and 50.

First of all, the bottle 74 has a modified neck finish 77 including a radially inwardly directed terminal flange 79 of which the outer surface defines a sealing surface 81. The exterior surface of the neck finish 77 includes conventional threads 82.

The neck finish 77 differs from the neck finish 22 both in the provision of the flange 79 and the shape of an opening 84 therethrough. The opening 84, which is best shown in FIG. 9, is part cylindrical and part angular so as to include a part circular portion 86 and two straight portions 88 disposed in angular relation to one another. The purpose of this cross section of the opening 84 will be described in detail hereinafter.

The measuring cup 78 includes a generally cylindrical body 90 which has a closed end 92 and an open end 94. Adjacent to but spaced from the open end 94 there is a radially outwardly directed flange 96 on the body 90. Between the flange 96 and the bottom 92, the body 90 is generally cylindrical externally. From the flange 96 to the open end 94, the body 90 is of an irregular cross section with this end portion being identified by the numeral 98 and shown in FIG. 9. It will be seen that the exterior cross section of the body portion 98 corresponds to that of the opening 84. Thus, when the measuring cup 78 is associated with the bottle 74, it will be locked against relative rotation.

The ring member 80 is similar to the ring members 32 and 54 in that is includes an annular flange 100 and a depending skirt 102 with the skirt having formed on the inner surface thereof threads 104 which cooperate with the threads 82 of the neck finish 77. Further, when the ring member 80 is in place, it bears against the upper surface of the body flange 96 to clamp the same against the sealing surface 81 with the flange 96 functioning as a gasket.

The closure unit 76 differs from the prior described closure units in that there is a threaded interlock between the body 90 and the ring member 80. As is clearly shown in FIG. 8, the body 90 is of an increased thickness in a radially outward direction as at 106. The exterior of this increased thickness portion 106 is provided with thread grooves 108.

The ring member 80 includes a sleeve-like portion 110 which extends axially from a radially inner part of the flange 100 and is provided on the inner surface thereof with threads 112 which engage in the thread grooves 108.

Finally, it is to be noted that the non-circular cross-sectional portion 98 of the body 90 is provided at the open end with a radially inwardly directed taper as at 114 so as to facilitate the alignment of the portion 98 with the opening 84.

Referring next to FIG. 8, it will be seen that when the ring member 80 is removed by rotating the same, not only will the ring member 80 unthread from the bottle 74, but also it will unthread from the measuring cup 78 so that when it becomes released from the bottle 74 there has been relative axial movement between the ring member 80 and the measuring cup 78 to the relationship shown in FIG. 10. This results in the open end 94 of the body 90 having moved from a retracted position within the skirt 102 to a projecting position as shown in FIG. 10. Thus, the measuring cup is now free to facilitate pouring in the manner shown in FIG. 11.

When the bottle 74 is to be reclosed, the closure unit is partially assembled with the neck finish 77 and then, when the ring member 80 is rotated to clamp the flange 96 against the sealing surface 81, the ring member 80 will feed down along the body 90 while it is also moving down on the neck finish 77. It is to be understood that the annular flange 100 will engage the body flange 96 in time so that further rotation of the ring member 80 will result in the required clamping of the flange 96 against the sealing surface 81.

Although only several preferred embodiments of the closure unit have been specifically illustrated and described herein, it is to be understood that further modifications may be made in the closure unit without departing from the spirit and scope of the invention as defined by the appended claims.

I claim:

1. A closure unit comprising a measuring cup and a ring member, said measuring cup including a generally cylindrical body having an open end and a bottom, said body being of an external diameter to be received in a neck of a container to be closed by said closure unit, a combined positioning and sealing flange carried by the exterior of said body in sealed relation to said body for engaging in sealed relation a sealing lip of a container to be closed, said flange being disposed adjacent to but positively spaced from said body open end, said ring member including an annular flange and a depending skirt, said annular flange defining an opening receiving said mesuring cup with said annular flange overlying said measuring cup flange for clamping said measuring cup flange against a container sealing lip, and retaining means on said skirt for interlocking engagement with a container neck finish, said body having a sliding close fit within said ring member opening, said body open end being recessed within said skirt when said annular flange is engaged with said measuring cup flange, and said ring member being slidable on said body to a position wherein said body open end projects axially beyond said skirt whereby said ring member in no way interferes with the pouring of a product from said measuring cup.

2. A closure unit according to claim 1 wherein said annular flange has a sleeve-like axial extension, and there are cooperating releasable interlocking means on said axial extension and said body for normally retaining said annular flange in engagement with said measuring cup flange.

3. A closure unit according to claim 2 wherein said body between said flange thereof and said open end is of a shape other than circular in cross section for interlocking against rotation in a container mouth of like cross section.

4. A closure unit according to claim 2 wherein said body between said flange thereof and said open end is of a shape other than circular in cross section for interlocking against rotation in a container mouth of like cross section, and said retaining means on said skirt are threads whereby when said measuring cup is restrained against axial movement relative to an associated container and said ring member is rotated and released, said ring member automatically moves axially relative to said measuring cup to release said cooperable releasable interlocking means and make ready said measuring cup for use.

5. A closure unit according to claim 4 wherein said cooperable releasable interlocking means are in the form of threads.

6. A closure unit according to claim 2 wherein said body between said flange thereof and said open end is of a shape other than circular in cross section for interlocking against rotation in a container mouth of like cross section, and said retaining means on said skirt are threads whereby said closure unit is reapplied to a container, the rotation of said ring member in threaded contact with a container neck finish will automatically result in relative axial movement between said ring member and said measuring cup to reengage said cooperable releasable interlocking means.

7. A closure unit according to claim 3 wherein said body at said open end is tapered in a radially inward direction to facilitate entry into a container.

* * * * *